US012722195B2

(12) United States Patent
Minor, Sr. et al.

(10) Patent No.: US 12,722,195 B2
(45) Date of Patent: Sep. 1, 2026

(54) APPARATUS FOR SHAPING AN ADVANCING FORMABLE SHEET AND METHOD OF MAKING THE APPARATUS

(71) Applicant: KWM Gutterman, Inc., Rockdale, IL (US)

(72) Inventors: Kenneth W. Minor, Sr., Minooka, IL (US); Keith W. Minor, Channahon, IL (US)

(73) Assignee: KWM Gutterman, Inc., Rockdale, IL (US)

( * ) Notice: Subject to any disclaimer, the term of this patent is extended or adjusted under 35 U.S.C. 154(b) by 276 days.

(21) Appl. No.: 18/734,889

(22) Filed: Jun. 5, 2024

(65) Prior Publication Data

US 2025/0375808 A1 Dec. 11, 2025

(51) Int. Cl.
*B21D 5/08* (2006.01)

(52) U.S. Cl.
CPC ..... *B21D 5/08* (2013.01)

(58) Field of Classification Search
CPC ..... B21D 5/08; B21D 5/083
See application file for complete search history.

(56) References Cited

U.S. PATENT DOCUMENTS

| | | | | |
|---|---|---|---|---|
| 4,811,587 | A * | 3/1989 | Knudson | B21D 5/08 72/181 |
| 4,899,566 | A * | 2/1990 | Knudson | B21D 5/08 72/247 |
| 5,394,722 | A * | 3/1995 | Meyer | B21D 5/08 72/181 |
| 10,814,372 | B2 | 10/2020 | Minor, Sr. | |
| 2004/0000181 | A1* | 1/2004 | Knudson | B21D 5/08 72/176 |
| 2012/0204615 | A1* | 8/2012 | Schell | B21B 39/14 72/428 |

* cited by examiner

*Primary Examiner* — Bobby Yeonjin Kim
(74) *Attorney, Agent, or Firm* — Wood, Phillips, Katz, Clark & Mortimer

(57) ABSTRACT

An apparatus for shaping a formable sheet advancing in a travel path has a main frame and a unitary subframe on the main frame. Driven and guide keel rollers are operatively mounted to the subframe so that there is a predetermined relationship between turning axes on the driven and guide keel rollers. Sheet shaping assemblies progressively shape a sheet advanced by the driven keel rollers.

24 Claims, 8 Drawing Sheets

*Fig. 1*
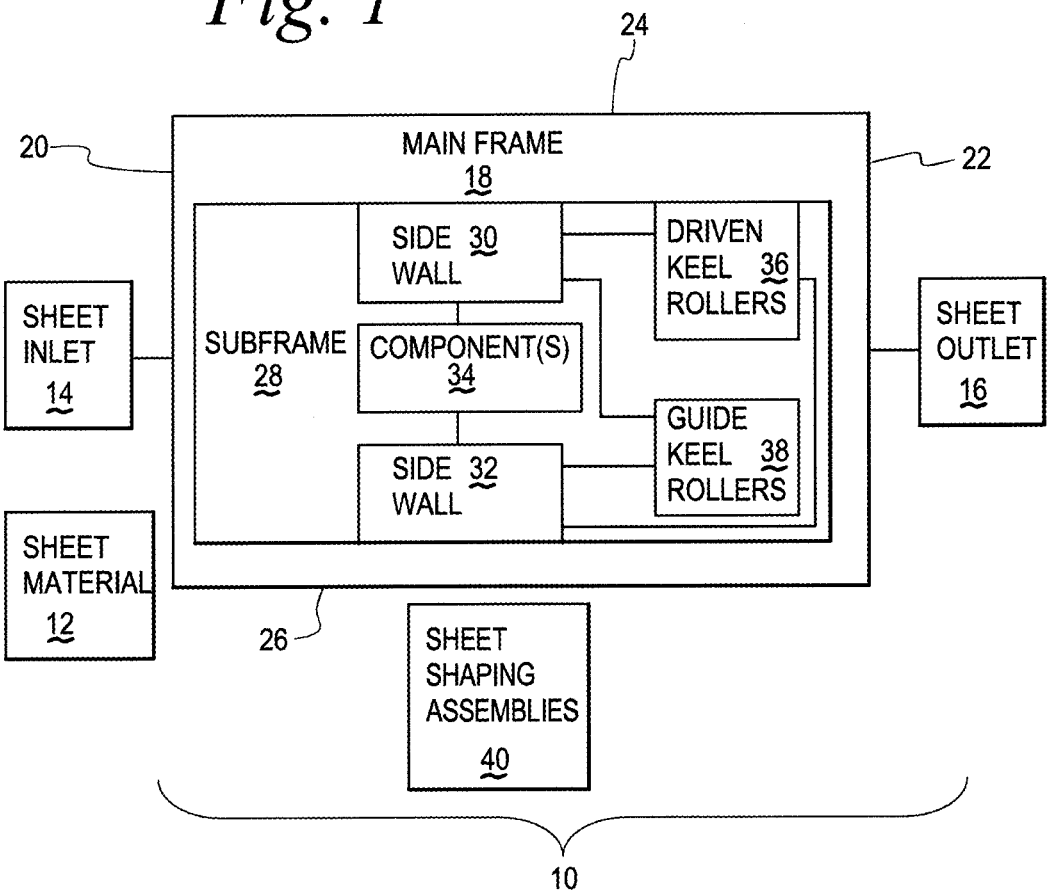
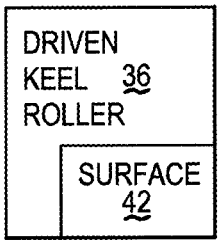
*Fig. 2*
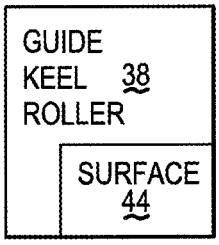
*Fig. 3*

APPARATUS FOR SHAPING AN ADVANCING FORMABLE SHEET AND METHOD OF MAKING THE APPARATUS

BACKGROUND OF THE INVENTION

Field of the Invention

This invention relates to apparatus for continuously shaping a formable sheet as to form, without limitation, gutters. The invention is further directed to a method of making such an apparatus.

Background Art

The invention described herein will be focused upon the continuous formation of a starting sheet material into a gutter. It should be understood that the inventive concepts can be used to form different products, with the gutter being representative in nature only.

Gutter forming apparatus have been used in manufacturing facilities and on jobsites for decades. With a typical construction, a flat sheet material, as stored in a roll form, is fed into the apparatus and progressively reconfigured, as it is advanced, by components at spaced "stations" until it assumes a predetermined end shape, which discharges at an outlet location. Exemplary sheet forming apparatus are shown in U.S. Pat. No. 4,899,566 (Knudson) and U.S. Pat. No. 5,394,722 (Meyer). The disclosure in each of these patents is incorporated herein by reference.

Common to most gutter forming apparatus is a main frame upon which individual components are mounted. To produce a uniform end product shape, it is critical that the sheet material be advanced consistently in a predetermined travel path between inlet and outlet locations on the apparatus.

Key to this sheet alignment is the "keel" region, defined by a plurality of components/rollers, which initially provide an upwardly facing support for the incoming sheet and establish a consistent horizontal support for the advancing sheet material, ultimately at the bottom of the completed gutter product. The peripheral surfaces of the keel rollers collectively reside in a horizontal support plane for the advancing sheet so that the vertical sheet position is controlled to consistently cooperate with components on sheet shaping assemblies, that are at the different stations and progressively form the advancing sheet. The assemblies at these stations commonly have components that are either in direct cooperation with the driven keel rollers or operate independently thereof.

Commonly, a plurality of the driven keel rollers, which each may cooperate with a forming roller, are spaced along the travel path for the sheet. Between the driven keel rollers are undriven guide keel rollers. The guide keel rollers are typically follower rollers that are not independently driven.

Heretofore, a main frame has been utilized and defines a foundation for all other operating components. Side walls are independently attached to the main frame and bridged by the driven keel rollers and the guide keel rollers. The driven and guide keel rollers are mounted to the side walls in a manner that they can be adjusted independently relative to the side walls, at time of manufacture and by end users in the field.

Regardless of the design, and the precision with which the main frame and other parts of these apparatus are manufactured, there are inherent dimensional and shape deviations that necessitate fine tuning during component assembly, particularly when there are multiple driven and guide keel rollers incorporated.

In one method of manufacture, a horizontal string line is clamped in place along the Y axis and defines a reference line from which component positions can be gauged. In the case of the driven and supporting keel rollers, the individual rollers are adjusted using this common reference. With the side walls secured to other parts of the main frame, there are potentially deviations in different dimensions. The side walls may not be in perfect alignment with each other and/or the main frame along the Y axis. Further, slight misalignment of the side walls along the length of the main frame, between its inlet and discharge ends, may cause potential skewing of the axes for the driven and guide keel rollers, which may adversely affect the quality of the end product.

The side walls are commonly mounted to the main frame to be adjustable relative to the main frame and each other, with the rollers in turn adjustable independently relative to the side walls.

Since all components are independently mounted on the main frame to be movable relative to each other, the main frame becomes the primary reference structure. Any main frame inconsistencies may affect positioning of all other independent components. This often necessitates independent shimming of multiple components and performance of time consuming and difficult alignment steps.

At time of manufacture, each of the individual driven and guide keel rollers must be precisely adjusted to achieve the overall optimal keel roller alignment. This process is inherently time-consuming and precision may be compromised in the event that there is some irregularity in the overall shape of the main frame or the proper steps have not been taken to ensure precise alignment between the side walls, the main frame, and the keel rollers.

This construction also introduces problems that may be encountered in the field by end users. In the event that one of the driven or guide keel rollers is damaged or becomes misaligned, the end user has the options of either attempting to remedy the situation onsite or returning the apparatus to the manufacturer for service. In either event, and particularly in the latter case, jobs may be interrupted for significant lengths of time. Further, such alignment requires a level of skill that may not be present with workers at a site.

The industry continuously seeks improvements in sheet forming apparatus that contribute to reliability, limited downtime, ease of maintenance and repair, and the consistent formation of a high quality end product.

SUMMARY OF THE INVENTION

In one form, the invention is directed to an apparatus for shaping a formable sheet advancing in a travel path between sheet inlet and sheet outlet locations on the apparatus. The apparatus includes: a main frame having spaced ends and laterally spaced sides; a subframe on the main frame; a plurality of driven keel rollers each with a turning axis and a sheet engaging surface; and a plurality of sheet shaping assemblies spaced along the sheet travel path for progressively shaping the formable sheet from a starting shape at the sheet inlet location to a predetermined, selected end shape at the sheet outlet location as the formable sheet advances in the sheet travel path. The subframe has laterally spaced side walls between which at least one component extends so as to maintain a fixed relationship between the laterally spaced side walls. A first driven keel roller in the plurality of driven keel rollers is operatively mounted to the subframe so that the turning axis of the first driven keel roller is in a predetermined relationship with the laterally spaced side walls. A second driven keel roller in the plurality of driven rollers is operatively mounted to the subframe so that the turning axis of the second keel roller is in a predetermined relationship with the laterally spaced side walls and the turning axis of the operatively mounted first driven keel roller. The operatively mounted second driven keel roller is spaced along the sheet travel path from the operatively mounted first driven keel roller. The plurality of driven keel rollers are configured to cooperatively engage and advance a formable sheet in the sheet travel path.

In one form, the operatively mounted first and second driven keel rollers each is connected to the laterally spaced side walls.

In one form, the apparatus for shaping a formable sheet further includes a plurality of guide keel rollers each with a turning axis and a sheet engaging surface. A first guide keel roller in the plurality of guide keel rollers is operatively mounted to the subframe between the first and second driven keel rollers. The turning axis of the first guide keel roller is in a predetermined relationship with the laterally spaced side walls.

In one form, axial lengths of the sheet engaging surfaces on the first and second driven keel rollers and the first guide keel roller, in contact with a formable sheet advancing in the travel path, reside within a plane.

In one form, axial lengths of the sheet engaging surfaces on the first and second driven keel rollers, in contact with a formable sheet advancing in the travel path, reside within a plane.

In one form, the laterally spaced side walls and the at least one component extending between the side walls are formed as one piece.

In one form, the subframe is elongate with a length. The subframe is U-shaped as viewed along the length of the subframe.

In one form, the subframe is a unit made up of the spaced side walls. The at least one component extends between the side walls that is operatively connected to the main frame.

In one form, the subframe is elongate with a length and is defined by a sheet component that is bent into a "U" shape as viewed along the length of the subframe.

In one form, one of the sheet shaping assemblies in the plurality of sheet shaping assemblies has a roller that cooperates with and is driven by the first driven keel roller.

In one form, the plurality of sheet shaping components are configured so that the end shape of the sheet at the sheet outlet location is a gutter shape.

In one form, a third driven keel roller in the plurality of driven keel rollers is operatively mounted to the subframe so that the turning axis of the third driven keel roller is in a predetermined relationship with: a) the laterally spaced side walls; and b) the turning axes of each of the operatively mounted first and second driven keel rollers.

In one form, the first driven keel roller and subframe are configured so that the predetermined relationship between the turning axis of the first driven keel roller and laterally spaced side walls is the only relationship that can be established between the turning axis of the first driven keel roller and the laterally spaced side walls with the first driven keel roller operatively mounted to the subframe.

In one form, the first guide keel roller and subframe are configured so that the predetermined relationship between the turning axis of the first guide keel roller and the laterally spaced side walls is the only relationship that can be established between the turning axis of the first guide keel roller and the laterally spaced side walls with the first guide keel roller operatively mounted to the subframe.

In one form, the first guide keel roller has a shaft with spaced ends journaled for rotation, one each, on one of the laterally spaced sides walls.

In one form, the first driven keel roller is supported on a base with spaced sides. The spaced sides of the base are connected, one each, to one of the laterally spaced side walls with the first driven keel roller operatively mounted to the subframe.

In one form, at least one of the laterally spaced side walls has an upwardly opening receptacle into which a part of the base is directed in operatively mounting the first driven keel roller to the subframe.

In one form, the spaced sides of the base are fixedly connected, one each, to one of the laterally spaced side walls with the first driven keel roller operatively mounted to the subframe.

In one form, a second guide keel roller in the plurality of guide keel rollers is operatively mounted to the subframe between the first and second driven keel rollers.

In one form, the apparatus is configured so that the starting shape of the formable sheet at the sheet inlet location is flat.

In one form, the invention is directed to a method of making an apparatus for continuously shaping a formable sheet advancing in a travel path. The method includes the steps of: obtaining a main frame having spaced ends and laterally spaced sides; obtaining a subframe comprising laterally spaced side walls between which at least one component extends so that the laterally spaced side walls and at least one component define a unit with a fixed configuration; connecting the subframe to the main frame; operatively mounting a plurality of driven keel rollers to the subframe unit each in a predetermined relationship to the other driven keel rollers in the plurality of driven keel rollers and the subframe unit; and operatively mounting sheet shaping assemblies on at least one of the main frame and subframe. The sheet shaping assemblies are configured to progressively shape a formable sheet supported on the plurality of driven keel rollers and advanced through operation of the plurality of driven keel rollers in the sheet travel path.

In one form, the method further includes a step of operatively mounting a plurality of guide keel rollers to the subframe unit each in a predetermined relationship to the other guide keel rollers in the plurality of guide keel rollers and the subframe unit.

In one form, the plurality of driven keel rollers and subframe unit are configured so that each of: a) the predetermined relationship between the plurality of the driven keel rollers with each other; and b) the predetermined relationship between the plurality of driven keel rollers and the subframe unit is an only predetermined relationship that can be established between the plurality of driven keel rollers and the plurality of driven keel rollers and subframe unit with the plurality of driven keel rollers operatively mounted to the subframe unit.

In one form, the plurality of driven keel rollers are releasably operatively mounted to the subframe unit.

In one form, the step of obtaining a subframe involves obtaining a sheet material and bending the sheet material to define the laterally spaced walls and the at least one component extends between the laterally spaced side walls.

BRIEF DESCRIPTION OF THE DRAWINGS

FIG. 1 is a schematic representation of one form of apparatus, according to the invention, for shaping a formable sheet advancing in a travel path between sheet inlet and sheet outlet locations;

FIG. 2 is a schematic representation of a driven keel roller on the apparatus in FIG. 1 and showing additional detail thereof;

FIG. 3 is a schematic representation of a guide keel roller on the apparatus in FIG. 1 and showing additional detail thereof;

DETAILED DESCRIPTION OF THE PREFERRED EMBODIMENT

Figure 4:
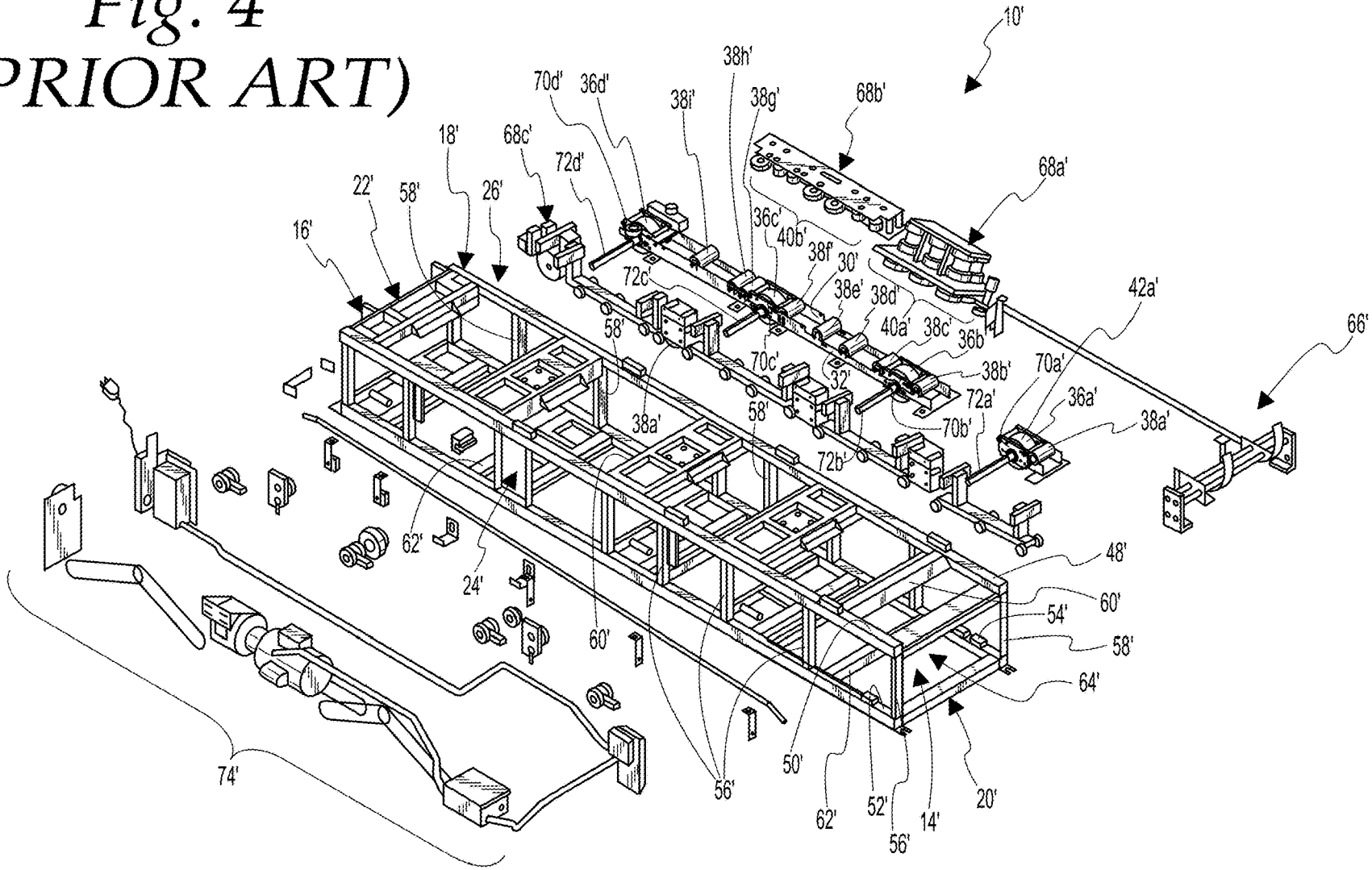
Fig. 4 (PRIOR ART)
FIG. 4 is an exploded perspective view of a conventional apparatus, of the type as shown in FIG. 1, and over which the present invention improves.
Figure 5:
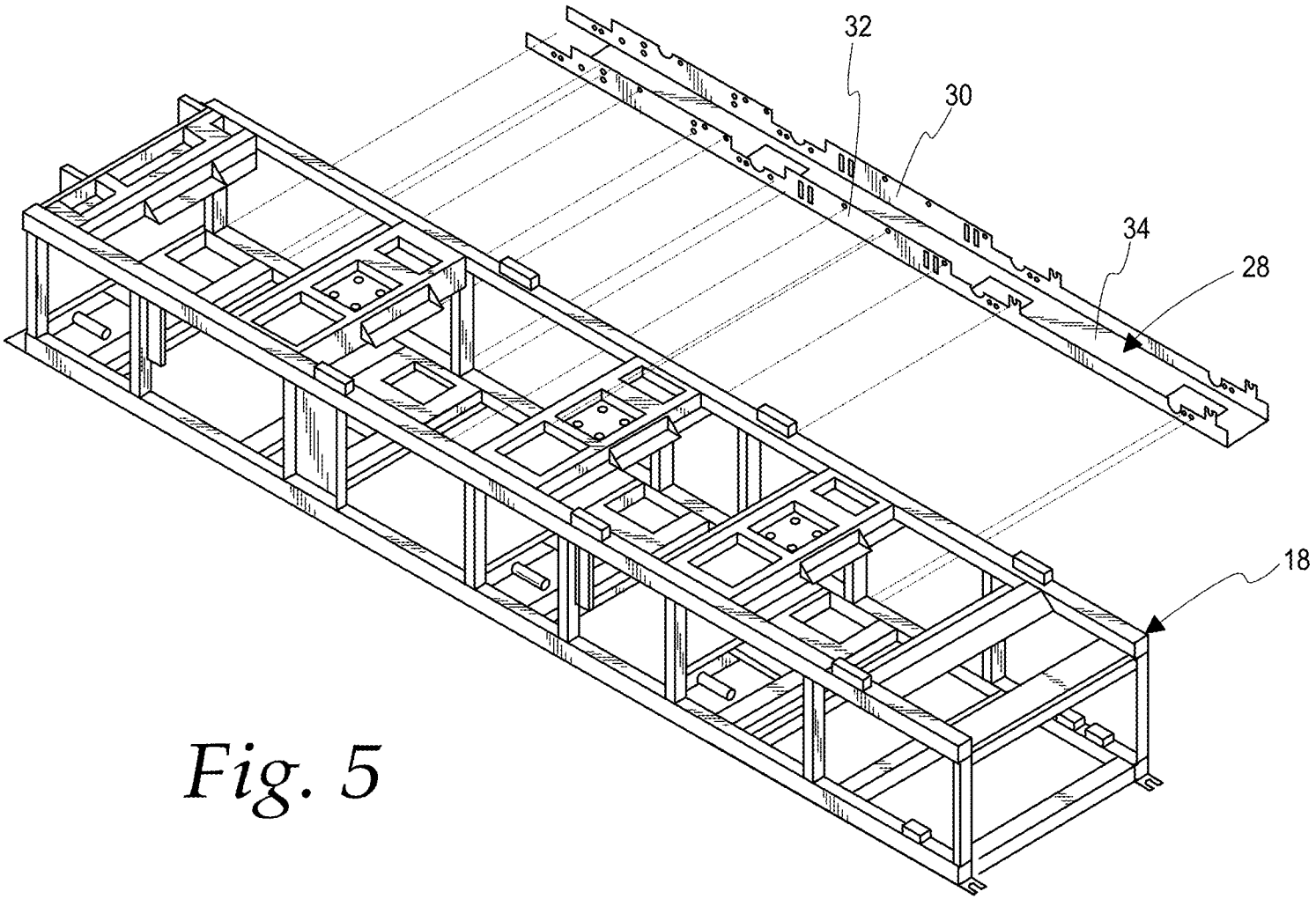
FIG. 5 is an exploded perspective view of an exemplary form of the main frame and subframe, as shown schematically in FIG. 1.

An apparatus for shaping a formable sheet, according to the present invention, is shown schematically in FIG. 1 at 10. The apparatus 10 is designed to shape any type of formable sheet material, as shown schematically at 12, that may be initially in a flat shape or rolled into a coiled supply. The sheet material is advanced in a travel path between a sheet inlet location 14 and a sheet outlet location 16.

The apparatus 10 has a main frame 18 with spaced ends 20, 22 and laterally spaced sides 24, 26.

A subframe 28 is provided on the main frame 18. The subframe 28 is elongate between spaced ends and has laterally spaced side walls 30, 32 between which at least one component 34 extends so as to maintain a fixed relationship between the laterally spaced side walls 30, 32 and define a unitary structure therewith.

A plurality of driven keel rollers 36 and a plurality of guide keel rollers 38 are operatively mounted on the subframe 28. All of the keel rollers 36, 38 have turning axes. A first of the driven keel rollers 36 is operatively mounted so that its turning axis is in a predetermined relationship with the laterally spaced side walls 30, 32. A second of the driven keel rollers 36 is operatively mounted to the subframe 28 so that the turning axis of the second driven keel roller 36 is in a predetermined relationship with the laterally spaced side walls 30, 32 as well as the turning axis of the operatively mounted first driven keel roller 36.

The operatively mounted second driven keel roller 36 is spaced along the sheet travel path from the first operatively mounted drive keel roller 36.

The plurality of driven keel rollers 36 are configured to cooperatively engage and advance a formable sheet in the sheet travel path.

The apparatus 10 further has a plurality of sheet shaping assemblies 40 spaced along the sheet travel path at stations at which the sheet is progressively reconfigured from a starting shape, at the sheet inlet 14, to a predetermined, selected end shape, at the sheet outlet 16, as the formable sheet advances in the sheet travel path.

While the plurality of guide keel rollers 38 is shown on the subframe 28, it is contemplated that only the plurality of driven keel rollers 36 might be provided on the subframe 28.

Further, the sheet shaping assemblies 40, within the schematic showing in FIG. 1, may be mounted on one or both of the main frame 18 and subframe 28, or even further may be supported by still another structure.

In one preferred form, the operatively mounted first and second driven keel rollers 36 each is connected to the laterally spaced side walls 30, 32.

As shown in FIG. 2, each of the driven keel rollers 36 has a peripheral sheet engaging surface 42 extending around its respective turning axis. As shown in FIG. 3, each guide keel roller 38 has a corresponding, peripheral sheet engaging surface 44 extending around its respective turning axis.

In one form, a first of the guide keel rollers 38 is operatively mounted to the subframe 28 between spaced driven keep rollers 36 with its turning axis in a predetermined relationship with the laterally spaced side walls 30, 32 and also the turning axes of the driven keel rollers 36 operatively mounted to the subframe 28.

The driven keel rollers 36 and guide keel rollers 38 are arranged on the subframe 28 so that axial lengths of the surfaces 42, 44 are in contact with an underside surface of the advancing sheet and reside within a common plane.

The schematic depictions in FIGS. 1-3 are intended to encompass virtually a limitless number of different forms of each of the components therein and their interaction. The specific forms of the inventive structure described herein are exemplary in nature only and should not be viewed as limiting.

Further, the schematic depiction is provided to show the interaction of the primary components of the invention herein with virtually an unlimited number of other conventional type components, as shown, for example, in the Knudson and Meyer patents, referenced in the Background portion herein.

One specific form of apparatus, as made by the assignee herein, is shown at 10' in FIG. 4. Components corresponding to those shown in FIGS. 1-3 will be identified with the same reference numeral with the addition of the designation "'".

The main frame 18' has substantially parallel, lengthwise tubular components 48', 50', 52', 54' extending between the ends 20', 22'. The lengthwise components 50', 52' at one side 24' of the main frame 18' are joined by spaced, vertically extending components 56', with the lengthwise components 48', 54' at the other side 26' of the main frame 18' connected by corresponding vertically extending components 58'.

Horizontally extending components 60' span between the upper elongate components 48', 50' at spaced locations along the length thereof with corresponding horizontal components 62' spanning horizontally between the lower lengthwise components 52', 54', at the bottom of the main frame 18'.

The joined components 48', 50', 52', 54', 56', 58', 60', and 62' cooperatively extend around a through passage 64' between the ends 20', 22' of the main frame 18'.

A roll handling assembly 66' allows sheet material to be stored and paid out to move in the travel path between the sheet inlet 14' and the sheet outlet 16'.

As depicted, separate modules 68*a*', 68*b*', 68*c*' are mounted to the main frame 18' and have associated shaping assemblies generally designated 40*a*', 40*b*' for the representative modules 68*a*', 68*b*', respectively. As noted, the precise configuration and operation of the sheet shaping assemblies 40, 40' is not critical to the present invention and thus the details of those sheet shaping assemblies, as depicted schematically in FIGS. 1-3, will not be described herein. It suffices to say that there are several stages of forming as the sheet material advances through the different stations and is progressively reconfigured from a starting sheet shape to the predetermined selected end shape.

The side walls 30', 32' are independently mounted to the main frame 18' at a bottom wall defined cooperatively by the horizontal components 62'.

In the depicted form, there are four independent driven keel rollers 36*a*', 36*b*', 36*c*', 36*d*' with three of the driven keel rollers 36*b*', 36*c*', 36*d*' operatively mounted to the main frame 18' through the side walls 30', 32'.

The side walls 30', 32' are suitably mounted to the horizontal components 62' in a manner whereby they may potentially be adjusted relative to each other and the horizontal components 62', including in the Y-/vertical and X-/horizontal axes. Different shims may be used to set the desired position. The side walls 30', 32' are typically fixed relative to the main frame 18' using suitable, separate fasteners.

In this embodiment, there are nine guide keel rollers 38*a*', 38*b*', 38*c*', 38*d*', 38*e*', 38*f*', 38*g*', 38*h*', 38*i*', each supported at its axial opposite ends by the independently mounted side walls 30', 32'.

In this embodiment, the driven keel rollers 36*a*', 36*b*', 36*c*', 36*d*' each has an associated base/mount 70*a*', 70*b*', 70*c*', 70*d*', with each base/mount 70*a*', 70*b*', 70*c*', 70*d*' supported cooperatively by the side walls 30', 32'.

The driven keel rollers 36' each has a compressible high friction sheet engaging surface, with only one representative surface identified at 42*a*' on the driven keel roller 36*a*'. Each of the driven keel rollers, 36*a*', 36*b*', 36*c*', 36*d*' is driven around its respective turning axis through shafts 72*a*', 72*b*', 72*c*', 72*d*', by a suitable drive source 74'.

The driven keel rollers 36' drive the sheet in its travel path through cooperation with other components, such as components/rollers on the sheet shaping assemblies 40', between which the advancing sheet moves. This interaction may at the same time cause the driven keel rollers 36' to operate some or all of the sheet shaping assemblies 40'.

As noted above, by reason of the side walls 30', 32' being movable relative to each other and the main frame 18', during manufacture, adjustments must typically be made to align the driven keel rollers 36' and the guide keel rollers 38' through a relatively time-consuming process, as described above—as by precisely placing a reference guide line. Further, the precision demanded in terms of establishing alignment of the rollers 36', 38' may make it impractical for an end user to carry this out in the event that there is a misalignment or failure of one the rollers 36', 38'.

Details of an exemplary form of the inventive apparatus 10, as depicted schematically in FIGS. 1-3, are shown in FIGS. 5-14. The apparatus 10 in FIGS. 5-14 functions in substantially the same way as the apparatus 10', with the significant structural differences explained below. The description of the structure and operation of the apparatus 10', above, applies for the most part to the apparatus 10, and will not be repeated hereinbelow.

The subframe 28, as depicted, is constructed so that the side walls 30, 32 and component 34 are formed as one piece. It is thus possible, as depicted and preferred but not required, to form the subframe 28 by starting with a sheet material and bending it so that a "U" shape is defined, as viewed from the end of the subframe 28, by the side walls 30, 32 and the component 34 (from the inlet end 20 of the main frame 18 in FIG. 12 and from the outlet end 22 of the main frame 18 in FIG. 10).

The material making up the subframe 28 is of sufficient gauge that it will maintain its shape under the loads applied during operation. The subframe 28 can then be connected to the main frame 18 as a unit through appropriate fixation to the main frame 18, as to the horizontal components 62. As depicted, the subframe 28 is welded to the main frame 18, and may be shimmed as required to compensate for any main frame variations. Fixation by separate fasteners, that allow separation of the subframe 28 from the main frame 18 is also contemplated.

Figure 6:
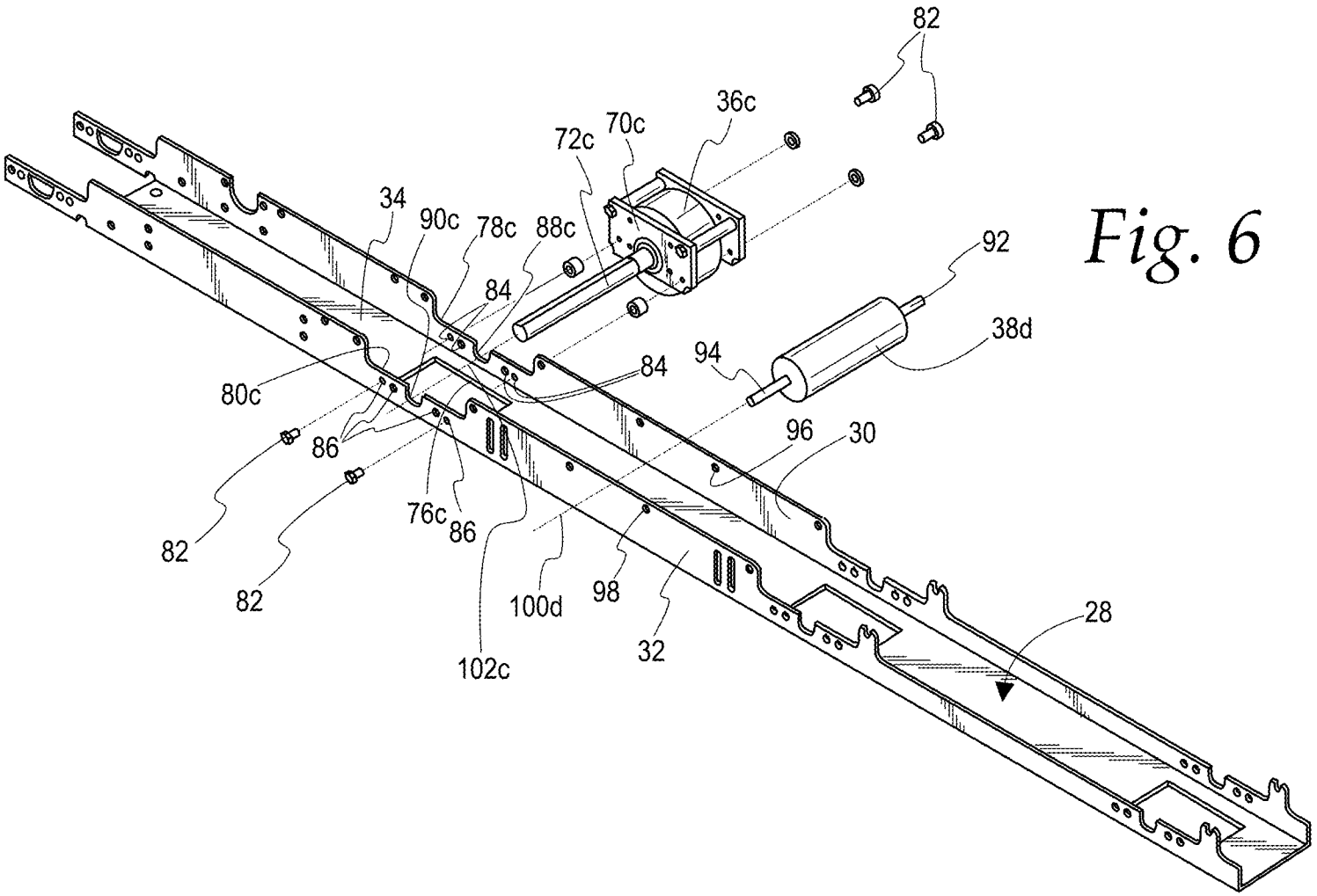
FIG. 6 is an enlarged, exploded view showing the subframe as in FIG. 5 and with exemplary forms of a driven keel roller and a guide keel roller, as shown schematically in FIG. 1.

All of the driven keel rollers 36 and guide keel rollers 38 may be operatively mounted to the subframe 28 in the same manner, although this is not required, to be operated by the drive 74. In one exemplary form, as shown in FIG. 6, the bottom wall/component 34 of the subframe 28 has a fully surrounded cutout 76*c* to accommodate the driven keel roller 36*c*. The walls 30, 32 have cutouts 78*c*, 80*c*, respectively, to accommodate the roller base/mount 70*c* which is lowered into place and fixed by appropriate fasteners 82 extended through the mount 70*c* at opposite sides thereof and into preformed openings 84, 86, respectively in the side walls 30, 32. This maintains the driven keel roller 36*c* in a single predetermined position relative to the subframe 28. Multiple predetermined positions may be allowed using the same mounting technique—as by providing separate sets of openings functioning as the openings 84, 86. The side walls 30, 32 have undercuts 88*c*, 90*c* to accommodate the shaft 72*c*.

The exemplary guide keel roller 38*d* is mounted in its operative position by extending oppositely projecting shaft ends 92, 94, respectively through preformed openings 96, 98 in the side walls 30, 32, respectively, whereat the shaft ends 92 and 94 are journaled for rotation around a fixed axis. The shaft ends may be extended through bearings (not shown) on the side walls 30, 32. Thus, the guide keel roller 38*d* is operatively mounted as through the discrete openings 96, 98 so that the turning axis 100*d* for the guide keel roller 38*d* is consistently aligned with the subframe 28 and with the turning axis 102*c* of the driven keel roller 36*c*. Additional sets of such openings may allow different predetermined relationships between the keel roller 38*d* and side walls 30, 32 to be selected.

Accordingly, the turning axes of all rollers 36, 38 attached to the subframe 28 can be fixed in a predetermined relationship with the subframe 28 and each other.

While it is possible to construct the apparatus 10 to allow multiple predetermined relationships between the axes of the rollers 36, 38 and the subframe 28, in one preferred form, the axes have only one permissible relationship with each other and the subframe 28.

Figure 7:
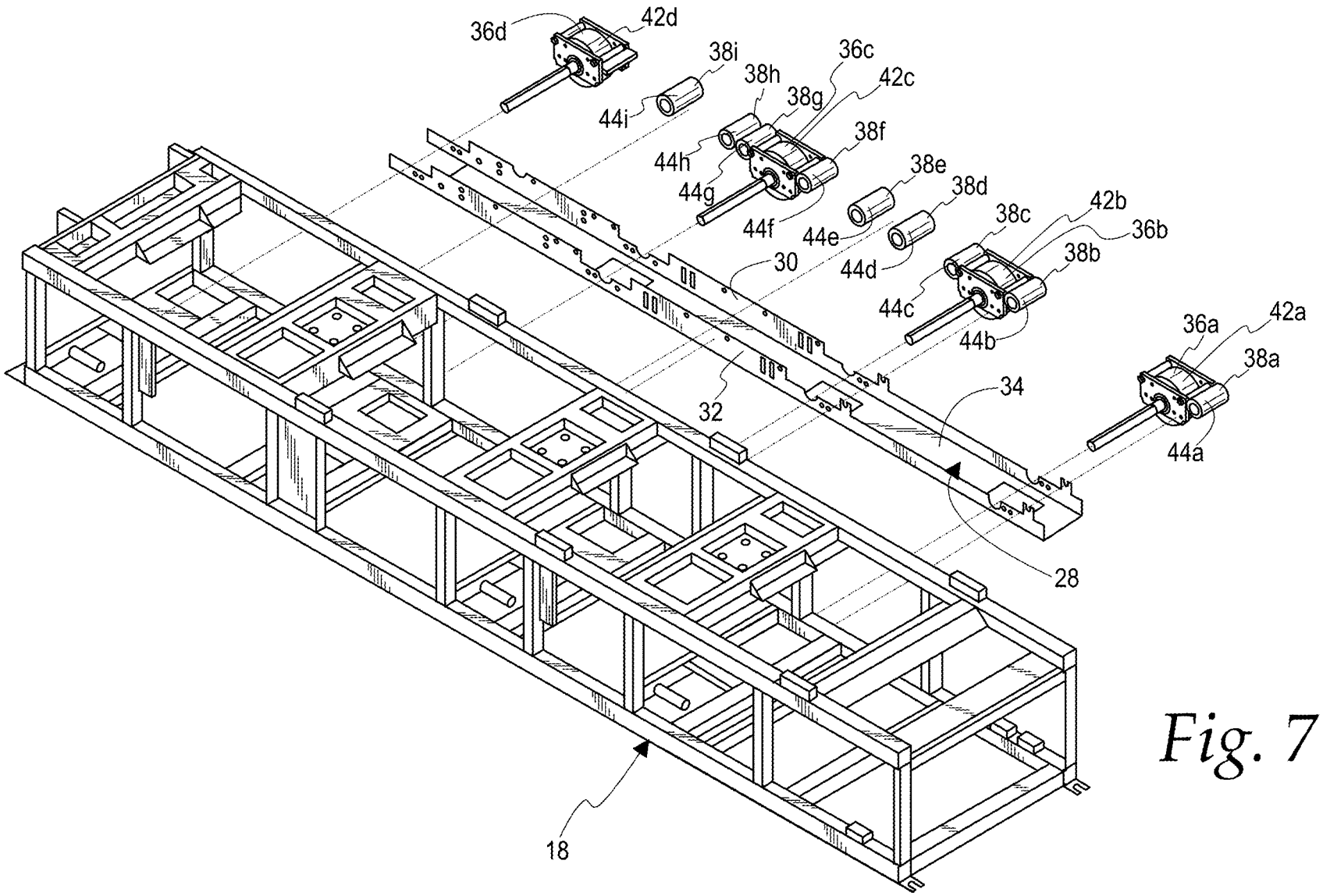
FIG. 7 is a view as in FIG. 5 and showing multiple driven and guide keel rollers.
Figure 8:
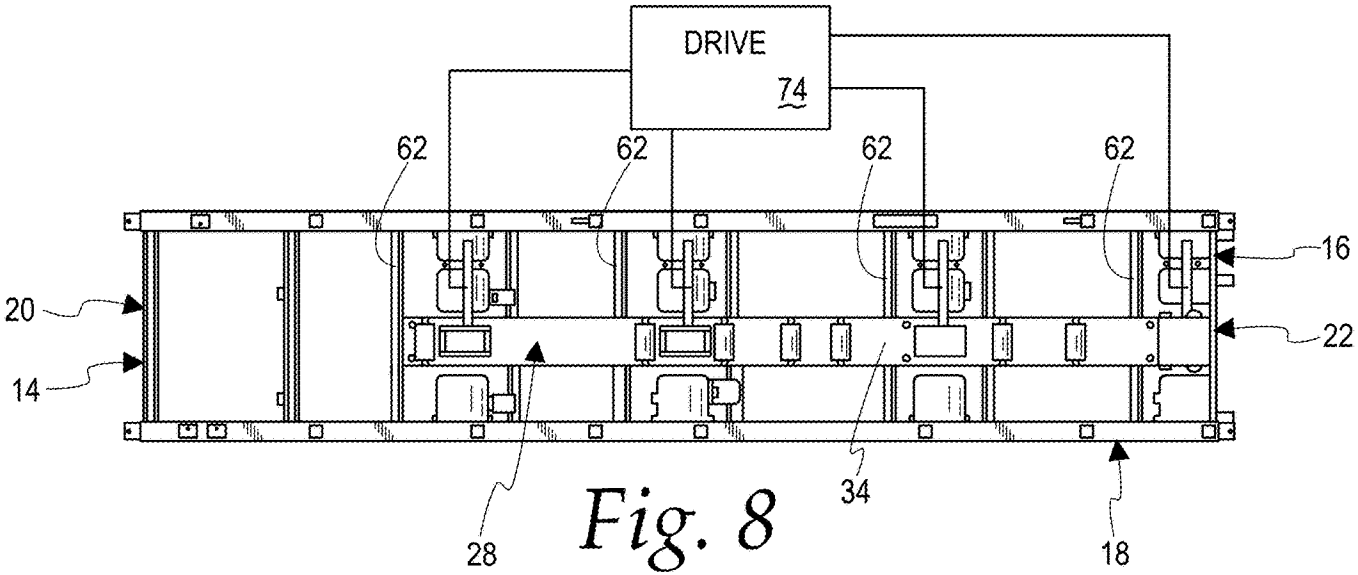
FIG. 8 is a plan view of the components in FIG. 7 and in an assembled state.
Figure 9:
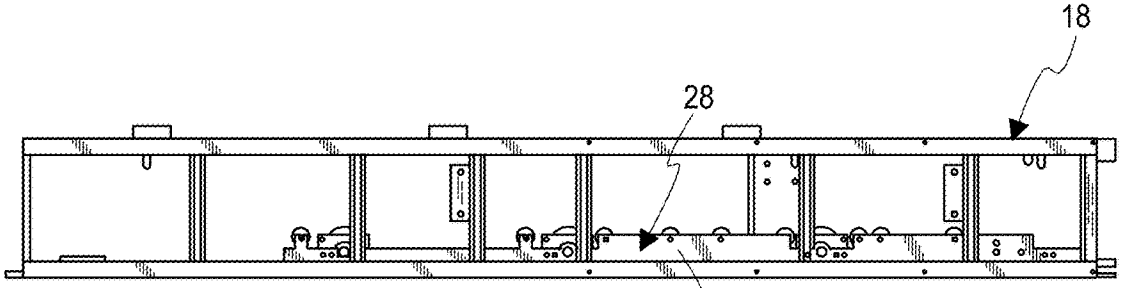
FIG. 9 is a side elevation view of the components in FIG. 8.
Figure 10:
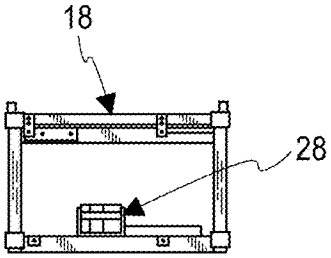
FIG. 10 is an end elevation view of the components in FIGS. 8 and 9.
Figure 12:
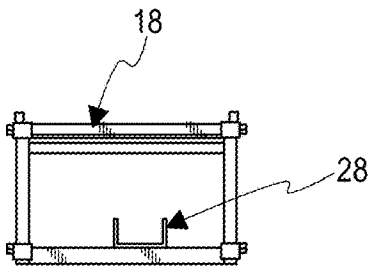
FIG. 12 is an end elevation view of the components in FIG. 11.
Figure 11:
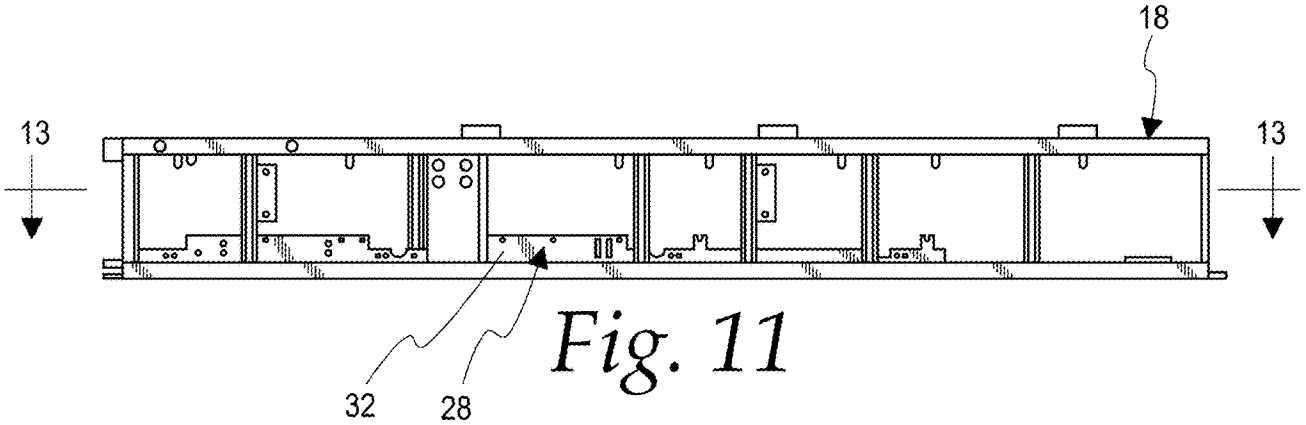
FIG. 11 is a view corresponding to that in FIG. 9 with the keel rollers removed.
Figure 13:
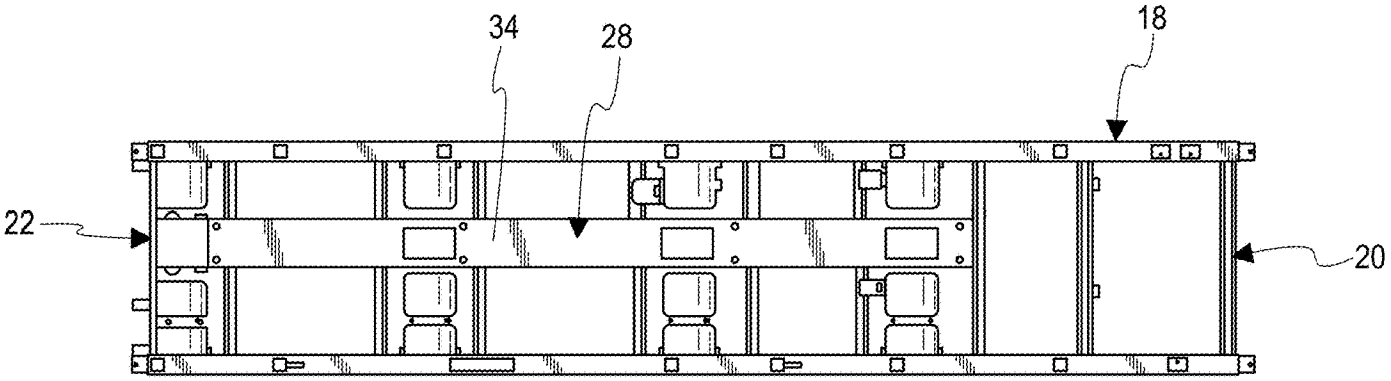
FIG. 13 is a cross-sectional view of the components in FIGS. 11 and 12 taken along line 13-13 of FIG. 12.
Figures 14, 15, 16:
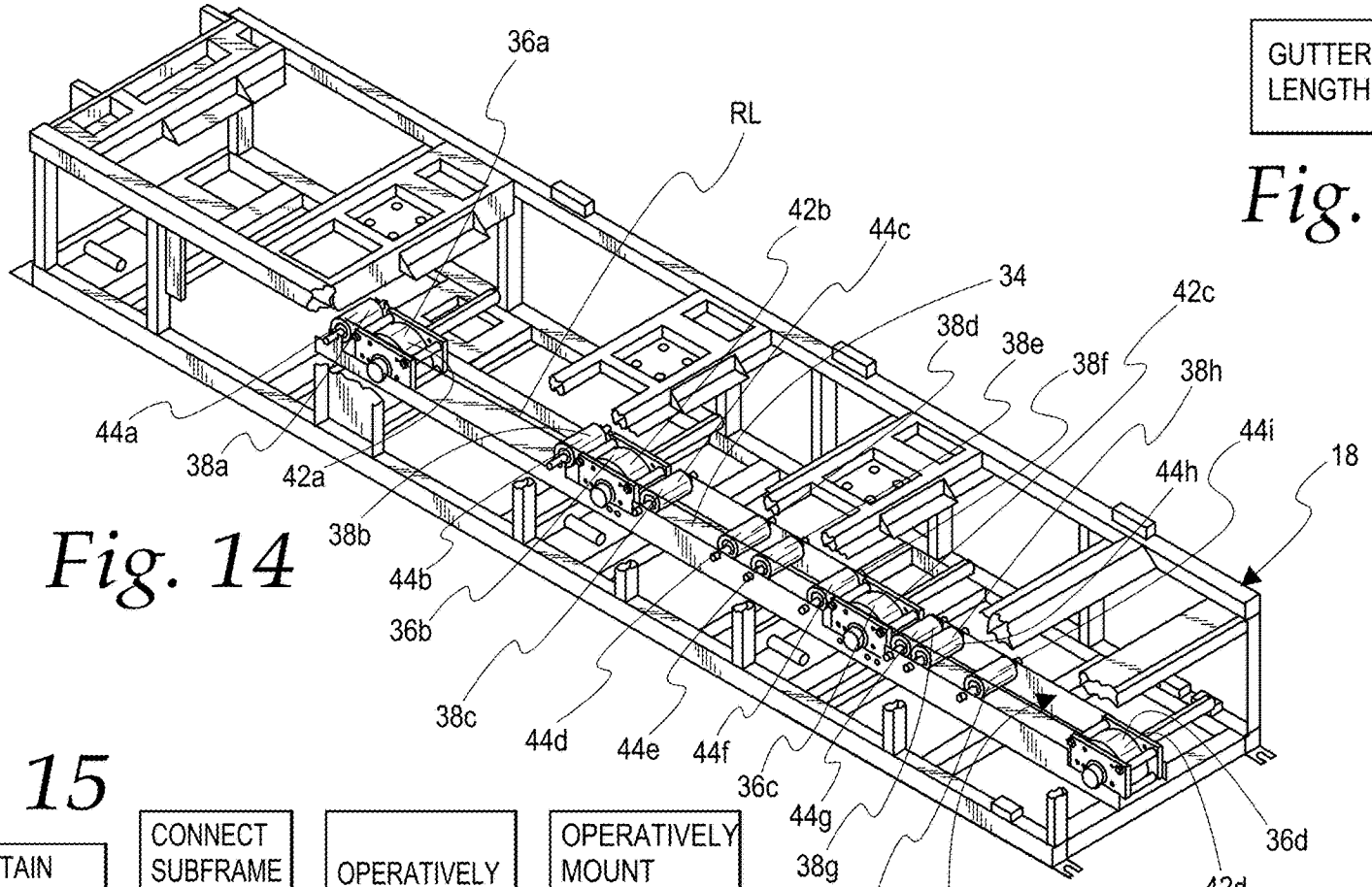
FIG. 14 is an enlarged, perspective view of the components in the FIG. 8 state.
FIG. 15 is a flow diagram representation of a method of making an apparatus for continuously shaping a formable sheet, according to the invention.
FIG. 16 is a schematic representation of one form of article made using the inventive method and apparatus.

Accordingly, the positions of some of or all components, affected by alignment, can be gauged off a common, unitary part—the subframe 28. As seen in FIGS. 7 and 14, the peripheral surfaces 42*a*, 42*b*, 42*c*, 42*d* successively on the driven keel rollers 36*a*, 36*b*, 36*c*, 36*d* reside in a common reference plane containing the reference line RL with the peripheral surfaces 44*a*, 44*b*, 44*c*, 44*d*, 44*e*, 44*f*, 44*g*, 44*h*, 44*i* successively on the guide keel rollers 38*a*, 38*b*, 38*c*, 38*d*, 38*e*, 38*f*, 38*g*, 38*h*, 38*i*—depicted without mounting shafts in FIG. 7. End users may be allowed to remove components such as a roller 36, 38 in the field and reinstall or replace them in the exact same position without having to address alignment issues.

The invention is also directed to a method of making an apparatus for continuously shaping a formable sheet advancing in a travel path. The method is depicted in flow diagram form in FIG. 15.

As shown at block 110, a main frame having spaced ends and laterally spaced sides is obtained.

As shown at block 112, a subframe is obtained having laterally spaced side walls between which at least one component extends so that the laterally spaced side walls and at least one component define a unit.

As shown at block 114, the subframe is connected to the main frame.

As shown at block 116, a plurality of driven and guide keel rollers are operatively mounted to the subframe unit, each in a predetermined relationship to each other and the subframe unit.

As shown at block 118, sheet shaping assemblies are operatively mounted on at least one of the main frame and subframe.

As shown in FIG. 16, one exemplary form of product produced performing the method using the inventive apparatus is a conventional gutter length 120, as shown, for example, in the Knudson patent, referenced above.

The foregoing disclosure of specific embodiments is intended to be illustrative of the broad concepts comprehended by the invention.

The invention claimed is:

1. An apparatus for shaping a formable sheet advancing in a travel path between sheet inlet and sheet outlet locations on the apparatus, the apparatus comprising:

a main frame having spaced ends and laterally spaced sides; a subframe on the main frame, wherein the subframe is elongate with a length, the subframe comprising laterally spaced side walls between which at least one component extends so as to maintain a fixed relationship between the laterally spaced side walls;

a plurality of driven keel rollers each with a turning axis and a sheet engaging surface, a first driven keel roller in the plurality of driven keel rollers operatively mounted to the subframe so that the turning axis of the first driven keel roller is in a predetermined relationship with the laterally spaced side walls;

a second driven keel roller in the plurality of driven rollers operatively mounted to the subframe so that the turning axis of the second keel roller is in a predetermined relationship with the laterally spaced side walls and the turning axis of the operatively mounted first driven keel roller, the operatively mounted second driven keel roller spaced along the sheet travel path from the operatively mounted first driven keel roller, the plurality of driven keel rollers configured to cooperatively engage and advance a formable sheet in the sheet travel path; and a plurality of sheet shaping assemblies spaced along the sheet travel path for progressively shaping the formable sheet from a starting shape at the sheet inlet location to a predetermined, selected end shape at the sheet outlet location as the formable sheet advances in the sheet travel path, the laterally spaced side walls and at least one component having a permanently fixed, unitary relationship and cooperatively defining a "U" shape as viewed along the length of the subframe.

2. The apparatus for shaping a formable sheet according to claim 1 wherein the operatively mounted first and second driven keel rollers each is connected to the laterally spaced side walls.

3. The apparatus for shaping a formable sheet according to claim 1 further comprising a plurality of guide keel rollers each with a turning axis and a sheet engaging surface, a first guide keel roller in the plurality of guide keel rollers operatively mounted to the subframe between the first and second driven keel rollers and with the turning axis of the first guide keel roller in a predetermined relationship with the laterally spaced side walls.

4. The apparatus for shaping a formable sheet according to claim 3 wherein axial lengths of the sheet engaging surfaces on the first and second driven keel rollers and the first guide keel roller, in contact with a formable sheet advancing in the travel path, reside within a plane.

5. The apparatus for shaping a formable sheet according to claim 1 wherein axial lengths of the sheet engaging surfaces on the first and second driven keel rollers, in contact with a formable sheet advancing in the travel path, reside within a plane.

6. The apparatus for shaping a formable sheet according to claim 1 wherein the laterally spaced side walls and the at least one component extending between the side walls are formed as one piece.

7. The apparatus for shaping a formable sheet according to claim 1 wherein the subframe is operatively connected to the main frame.

8. The apparatus for shaping a formable sheet according to claim 6 wherein the subframe is defined by a sheet component that is bent into the "U" shape.

9. The apparatus for shaping a formable sheet according to claim 1 wherein one of the sheet shaping assemblies in the plurality of sheet shaping assemblies comprises a roller that cooperates with and is driven by the first driven keel roller.

10. The apparatus for shaping a formable sheet according to claim 1 wherein the plurality of sheet shaping components are configured so that the end shape of the sheet at the sheet outlet location is a gutter shape.

11. The apparatus for shaping a formable sheet according to claim 1 wherein a third driven keel roller in the plurality of driven keel rollers is operatively mounted to the subframe so that the turning axis of the third driven keel roller is in a predetermined relationship with: a) the laterally spaced side walls; and b) the turning axes of each of the operatively mounted first and second driven keel rollers.

12. The apparatus for shaping a formable sheet according to claim 1 wherein the first driven keel roller and subframe are configured so that the predetermined relationship between the turning axis of the first driven keel roller and laterally spaced side walls is an only relationship that can be established between the turning axis of the first driven keel roller and the laterally spaced side walls with the first driven keel roller operatively mounted to the subframe.

13. The apparatus for shaping a formable sheet according to claim 3 wherein the first guide keel roller and subframe are configured so that the predetermined relationship between the turning axis of the first guide keel roller and the laterally spaced side walls is an only relationship that can be established between the turning axis of the first guide keel roller and the laterally spaced side walls with the first guide keel roller operatively mounted to the subframe.

14. The apparatus for shaping a formable sheet according to claim 13 wherein the first guide keel roller has a shaft with spaced ends journaled for rotation, one each, on one of the laterally spaced side walls.

15. The apparatus for shaping a formable sheet according to claim 1 wherein the first driven keel roller is supported on a base with spaced sides, the spaced sides of the base connected, one each, to one of the laterally spaced side walls with the first driven keel roller operatively mounted to the subframe.

16. The apparatus for shaping a formable sheet according to claim 15 wherein at least one of the laterally spaced side walls has an upwardly opening receptacle into which a part of the base is directed in operatively mounting the first driven keel roller to the subframe.

17. The apparatus for shaping a formable sheet according to claim 16 wherein the spaced sides of the base are fixedly connected, one each, to one of the laterally spaced side walls with the first driven keel roller operatively mounted to the subframe.

18. The apparatus for shaping a formable sheet according to claim 3 wherein a second guide keel roller in the plurality of guide keel rollers is operatively mounted to the subframe between the first and second driven keel rollers.

19. The apparatus for shaping a formable sheet according to claim 1 wherein the apparatus is configured so that the starting shape of the formable sheet at the sheet inlet location is flat.

20. A method of making an apparatus for continuously shaping a formable sheet advancing in a travel path, the method comprising the steps of:

obtaining a main frame having spaced ends and laterally spaced sides;

obtaining a subframe comprising laterally spaced side walls between which at least one component extends so that the laterally spaced side walls and at least one component have a permanently fixed, unitary relationship, wherein the subframe is elongate with a length and has a "U" shape as viewed along the length of the subframe;

connecting the subframe to the main frame;

operatively mounting a plurality of driven keel rollers to the subframe unit each in a predetermined relationship to the other driven keel rollers in the plurality of driven keel rollers and the subframe unit; and operatively mounting sheet shaping assemblies on at least one of the main frame and subframe, the sheet shaping assemblies configured to progressively shape a formable sheet supported on the plurality of driven keel rollers and advanced through operation of the plurality of driven keel rollers in the sheet travel path.

21. The method of making an apparatus according to claim 20 further comprising the step of operatively mounting a plurality of guide keel rollers to the subframe unit each in a predetermined relationship to the other guide keel rollers in the plurality of guide keel rollers and the subframe unit.

22. The method of making an apparatus according to claim 20 wherein the plurality of driven keel rollers and subframe unit are configured so that each of: a) the predetermined relationship between the plurality of the driven keel rollers with each other; and b) the predetermined relationship between the plurality of driven keel rollers and the subframeunitis an only predetermined relationship that can be established between the plurality of driven keel rollers and the plurality of driven keel rollers and subframe unit with the plurality of driven keel rollers operatively mounted to the subframe unit.

23. The method of making an apparatus according to claim 20 wherein the plurality of driven keel rollers are releasably operatively mounted to the subframe unit.

24. The method of making an apparatus according to claim 20 wherein the step of obtaining a subframe comprises obtaining a sheet material and bending the sheet material to define the laterally spaced side walls and the at least one component that extends between the laterally spaced side walls.

* * * * *